US006266018B1

(12) United States Patent
Otomo

(10) Patent No.: US 6,266,018 B1
(45) Date of Patent: Jul. 24, 2001

(54) ANTENNA ASSEMBLY AND A MOBILE RADIO APPARATUS USING THE SAME

(75) Inventor: Shinichi Otomo, Sendai (JP)

(73) Assignee: Tokin Corporation, Miyagi (JP)

( * ) Notice: Subject to any disclaimer, the term of this patent is extended or adjusted under 35 U.S.C. 154(b) by 0 days.

(21) Appl. No.: 09/424,796

(22) PCT Filed: Apr. 12, 1999

(86) PCT No.: PCT/JP99/01926

§ 371 Date: Nov. 29, 1999

§ 102(e) Date: Nov. 29, 1999

(87) PCT Pub. No.: WO99/53566

PCT Pub. Date: Oct. 21, 1999

(30) Foreign Application Priority Data

Apr. 10, 1998 (JP) ..... 10-099434

(51) Int. Cl.[7] ..... H01Q 1/24

(52) U.S. Cl. ..... 343/702; 343/895; 343/900

(58) Field of Search ..... 343/702, 895, 343/900, 901, 906, 715; H01Q 1/24

(56) References Cited

U.S. PATENT DOCUMENTS 5,204,687 4/1993 Elliott et al. .
5,606,327 * 2/1997 Elliott et al. ..... 343/702

FOREIGN PATENT DOCUMENTS 0 764 998 A1 3/1997 (EP) .
0 892 457 A1 1/1999 (EP) .
0 903 804 A1 3/1999 (EP) .
2282705 4/1995 (GB) .
3-245603 11/1991 (JP) .
5-243829 9/1993 (JP) .
7-99404 4/1995 (JP) .
2646505 5/1997 (JP) .

OTHER PUBLICATIONS

Patent Abstracts of Japan vol. 095, No. 007, Aug. 31, 1995; & JP 07 099404 A (Nippon Antenna Co. Ltd.) Apr. 11, 1995.

* cited by examiner

*Primary Examiner*—Tan Ho
*Assistant Examiner*—Ephrem Alemu
(74) *Attorney, Agent, or Firm*—Frishauf, Holtz, Goodman, Langer & Chick, P.C.

(57) ABSTRACT

An antenna assembly (35) mounted to a mobile communication set by a holder (61) to be retractable therein and extendable therefrom comprises a whip antenna (51) having a contact (57) and a helical antenna (43) joined with each other through an insulator joint member (39). The holder (61) is connected to a transceiver circuit in the set. In an extended position, the whip antenna (51) is fed from the transceiver circuit through the contact (57) and the holder (61). A conductive sleeve (49) is connected to the helical antenna (43) and mounted on the joint member (39) to be in contact with the holder (61) in the retracted condition whereby the helical antenna (43) is fed by the transceiver circuit. The joint member (39) is fixed at opposite end portions to the whip antenna (51) and the sleeve (49) with an intermediate portion left therebetween and having an axial length selected from a range of 4 and 7 mm.

10 Claims, 2 Drawing Sheets

ANTENNA ASSEMBLY AND A MOBILE RADIO APPARATUS USING THE SAME

TECHNICAL FIELD

This invention relates to an antenna assembly which can be retracted in a housing of a mobile radio apparatus.

BACKGROUND ART

A mobile radio apparatus such as a portable radio receiver, a portable radio transceiver, a portable wireless communication terminal, and a portable telephone set, for example, a cellular phone set, a PHS (Personal Handyphone System) telephone set, or the like is provided with an antenna assembly so as to transmit and/or receive radio signals. A known type of the antenna assembly is retractably attached to a housing of the radio apparatus, typically, a portable one such as the portable telephone set.

An antenna assembly of the type is disclosed in JP-A 3-245603 (Reference I) includes a first antenna portion, a second antenna portion connected to the first antenna portion, and a holder fitted around the second antenna portion so that the second antenna portion is slidable through the holder. The holder is connected to a transceiver circuit in a housing of the portable telephone set. The holder serves to mechanically attach the antenna assembly to the housing of the portable telephone set and serves as an electrical contact for the first and the second antenna portions.

The first antenna portion comprises a helical antenna element, an antenna top formed by plastic molding to surround the helical antenna element for the purpose of protection, and a conductive sleeve having one end connected to the helical antenna element and extending in one direction to be exposed outward from the antenna top.

The second antenna portion comprises a whip antenna element formed by a conductive wire or thin rod and having one end fixed and connected to the sleeve, and an insulator jacket tube covering the whip antenna element to protect the whip antenna element. The second antenna portion has one end coupled to the sleeve and the other end provided with a stopper to inhibit the antenna assembly from dropping off from the holder.

When the antenna assembly is in an extended position, the holder is brought into contact with the stopper to be electrically connected thereto. In this state, the whip antenna element is electrically connected to the transceiver circuit through the stopper and the holder. In this manner, the helical antenna element and the whip antenna element connected in cascade serves to receive a radio signal, because the whip antenna element is electrically connected in cascade to the helical antenna element connected to the one end of the whip antenna element.

On the other hand, when the antenna assembly is in a retracted position, the holder is brought into contact with the sleeve. As a result, the whip antenna element and the helical antenna element are simultaneously connected to the transceiver circuit through the sleeve and the holder and are rendered active. In this event, the whip antenna element retracted in the housing often badly affects circuit components of the transceiver circuit in the housing. In order to avoid the problem, the sleeve and the stopper may be short-circuited in the retracted position by use of, for example, a coaxial structure so that the helical antenna element alone is rendered active while the whip antenna is left inactive, as disclosed in JP-A 5-243829 corresponding to BP-A-2257836 (Reference II).

In the above-mentioned antenna assembly, there is a large difference in the electric characteristic of the antenna, such as a resonance frequency and a VSWR (Voltage Standing Wave Ratio) thereof, between the antenna extended position and the antenna retracted position. In order to solve the problem, a matching circuit is usually used to adjust the difference.

However, the matching circuit must be carefully designed and adjusted in order to obtain excellent characteristics of the antenna assembly both in the antenna extended position and the antenna retracted position. This requires much time and labor.

There is also known in the prior art, for example, U.S. Pat. No. 5,204,687 (Reference III) and JP-B-2646505 (Reference IV) another structure of the antenna assembly where the conductor rod as the whip antenna element is not electrically connected with the helical antenna element but is insulated therefrom. In the structure, the whip antenna element is reliably disabled in the retracted without use of a special support structure such as the coaxial structure as shown in Reference II. While, the whip antenna element only serves for receiving the radio signal in the extended condition because the helical antenna element is no longer connected to the holder.

In detail, Reference IV discloses a dielectric joint member of a generally rod shape which is secured at one end thereof to the top end of the conductor rod of the whip antenna element. The joint member is partially covered with the conductive sleeve and is fitted at the other end portion with a coil bobbin. A helical coil or the helical antenna element is wound on the coil bobbin and is connected to the conductive sleeve. The dielectric cap covers on the coil bobbin, the helical coil element and the top end portion of the conductive sleeve together by, for example, the plastic molding to from the antenna top. In the connection, the conductive sleeve and the topend of the conductive rod of the whip antenna element are fixed to the joint member by plastic molding the joint member in a condition where the conductive sleeve and the top end of the conductive rod are inserted into a mold.

However, the inventor has found out a problem that the antenna assembly disclosed in reference III and IV considerably varies in its transmitting/receiving performance in dependence on the dimension of an axial length of the joint member.

It is an object of this invention to provide an antenna assembly comprising a helical antenna element and a whip antenna element mechanically fixed to each other and electrically separated from each other so that the helical antenna element alone is rendered active in a retracted position and so that the whip antenna element alone is rendered active in an extended position, wherein an excellent characteristic can easily be realized and formation of a matching circuit is also easily performed.

It is a another object of this invention to provide a mobile radio apparatus with the above-mentioned antenna assembly attached to a housing of the apparatus.

DISCLOSURE OF INVENTION

According to this invention, there is provided a mobile radio apparatus comprising a radio transceiver circuit, a housing accommodating the radio transceiver circuit, and an antenna assembly electrically connected to the radio transceiver circuit and mounted to the housing to be retractable in the housing into a retracted position and extendable out of the housing into an extended position, the antenna assembly comprising a first antenna portion, a second antenna portion and an insulator joint member joining the first antenna portion with the second antenna portion into a linear form to extend in one direction, wherein:

the first antenna portion comprises a helical antenna element having one end as a helical terminal, an insulator antenna top enclosing the helical antenna element, and a conductive sleeve connected to the helical terminal of the helical antenna element and having an exposed portion extending outward from the antenna top to an extending end in the one direction;

the second antenna portion comprises a whip antenna element having a whip end portion fixed with the joint member and having the opposite whip end, and a conductor stopper fixed to the opposite whip end; and the joint member is made of insulator material formed into a rod shape having a first and second joint end portions opposite to each other, the first joint end portion being fixed to the whip end portion of the whip antenna element, the second joint end portion being fixedly fitted in the exposed portion of the conductive sleeve, so that the joint member has an intermediate portion left between the whip end portion of the whip antenna element and the extending end of the conductive sleeve. The intermediate portion has a length selected from a range of 4 to 7 mm, the conductive sleeve acts as a feed to the first antenna portion from the transceiver circuit when the antenna assembly is in the retracted position, and the stopper acts as a feed to the second antenna portion from the transceiver circuit when the antenna assembly is an extended position.

According to this invention, there is also provided an antenna assembly which comprises first and second antenna portions connected to each other through a joint member to extend in one direction and which is adapted to be retracted and extended, wherein:

the first antenna portion comprises a helical antenna element having one end as a helical terminal, an insulator antenna top enclosing the helical antenna element, and a conductive sleeve connected to the helical terminal of the helical antenna element and having an exposed portion extending outward from the antenna top to an extending end in the one direction;

the second antenna portion comprises a whip antenna element having a whip end portion fixed with the joint member and having the opposite whip end, and a conductor stopper fixed to the opposite whip end; and the joint member is made of insulator material formed into a rod shape having a first and second joint end portions opposite to each other, the first joint end portion being fixed to the whip end portion of the whip antenna element, the second joint end portion being fixedly fitted in the exposed portion of the conductive sleeve, so that the joint member has an intermediate portion left between the whip end portion of the whip antenna element and the extending end of the conductive sleeve. The intermediate portion has a length selected from a range of 4 to 7 mm, the conductive sleeve acts as a feeding portion for the first antenna portion when the antenna assembly is in a retracted position, and the stopper acts as a feeding portion for the second antenna portion when the antenna assembly is an extended position.

BEST MODE FOR CARRYING OUT THE INVENTION

Figure 1:
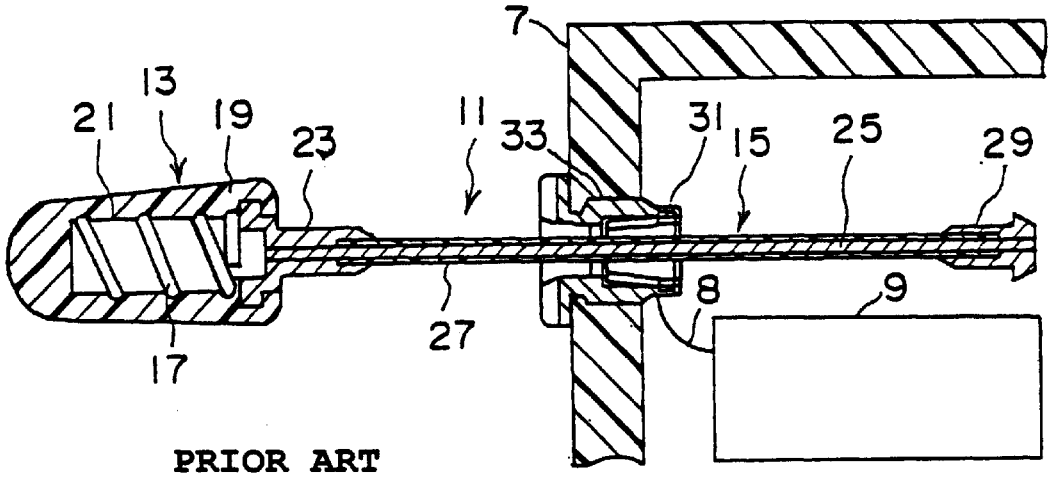
FIG. 1 is a sectional view of an existing antenna assembly.

For a better understanding of this invention, description will at first be made about a known antenna assembly disclosed in reference I with reference to FIG. 1.

Referring to FIG. 1, the known antenna assembly depicted at 11 comprises a first antenna portion 13 and a second antenna portion 15 connected to the first antenna portion 13.

The first antenna portion 13 comprises a helical antenna element 17, an antenna top 19 of plastic resin enclosing the helical antenna element 17 to protect the helical antenna element 17.

In the illustrated example, the antenna top 19 is formed by insertion plastic molding. However, the antenna top 19 may be a cap member coupled to the helical antenna element 17.

In order to avoid an error in helical pitches or deformation of the helical antenna element 17 upon forming the antenna top 19, the helical antenna element 17 may be supported by a helical bobbin 21 arranged inside. The first antenna portion 13 is provided with a conductive sleeve 23 having one end connected to one end of the helical antenna element 17 and the other end exposed outward from the antenna top 19 in the one direction.

The second antenna portion 15 comprises a whip antenna element 25 formed by a conductive wire or rod and having one end connected to the sleeve 23 and extending in one direction, and a face tube 27 arranged around the whip antenna element 25 to protect the whip antenna element 25.

The second antenna portion 15 is provided with a stopper 29 of a metal which is formed at the other end opposite to the one end connected to the sleeve 23 and which is electrically connected to the whip antenna element 25.

Around the second antenna portion 15, a holder 33 is attached. The holder 33 has an internal spring 31 arranged along its inner surface so that the second antenna portion 15 is slidable therethrough. The holder 33 is attached to a housing 7 of a radio apparatus to enable the antenna assembly 11 to be retracted into the housing 7. The radio apparatus has a transceiver circuit 9 in the housing 7. The holder 33 and at least the spring 31 are made of metal, and the holder 33 is electrically connected to the transceiver circuit 9 through a feeding line 8.

When the antenna assembly 11 is in a retracted position, the first antenna portion 13 including the helical antenna element 17 alone is exposed outside of the housing and serves to receive a radio signal. At this time, the sleeve 23 electrically connected to the helical antenna element 17 is brought into contact with the internal spring 31 of the holder 33 and therefore, serves as a feeding portion for the helical antenna element 17. In addition, the antenna assembly 11 is held and fixed by the internal spring 31 when it is retracted.

When the antenna assembly is in an extended position, the stopper 29 at the other end of the second antenna portion 15 serves as a feeding portion in contact with the internal spring 31 of the holder 33, like the sleeve 23 in the retracted position. Again, the antenna assembly 11 is held and fixed by the internal spring 31 when it is extended.

Now, one embodiment of this invention will be described with reference to FIGS. 2 through 5, in which the radio apparatus is omitted because it is similar to that in FIG. 1.

Figure 2:
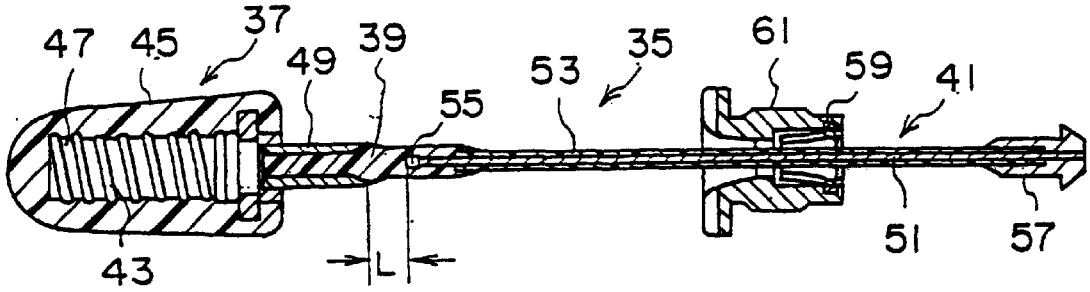
FIG. 2 is a sectional view of an antenna assembly according to one embodiment of this invention.

Referring to FIG. 2, an antenna assembly 35 according to the present invention comprises a first antenna portion 37 and a second antenna portion 41 connected through a joint member 39 of an insulator such as plastic resin to the first antenna portion 37.

The first antenna portion 37 comprises a helical antenna element 43, and an antenna top 45 enclosing the helical antenna element 43 to protect the helical antenna element 43. In the illustrated example, the antenna top 45 is formed by insertion plastic molding. However, the antenna top 45 may be a cap member of a plastic resin coupled to the helical antenna element 43.

In order to avoid an error of helical pitches or deformation of the helical antenna element 43 upon forming the antenna top 45, the helical antenna element 43 may be supported by a helical bobbin 47 arranged inside. The first antenna portion 37 is provided with a conductive sleeve 49 having one end connected to one end of the helical antenna element 43 and the other end exposed outward from the antenna top 45 in the one direction. Therefore, the sleeve 49 has an exposed portion and an extended end as the other end.

The second antenna portion 41 comprises a whip antenna element 51 formed by a conductive wire or rod and having one end connected to the sleeve 49 through the joint member 39 and extending in the one direction, and an outer jacket tube 53 of an insulator covering the whip antenna element 51 to protect the whip antenna element 51.

Figure 3:
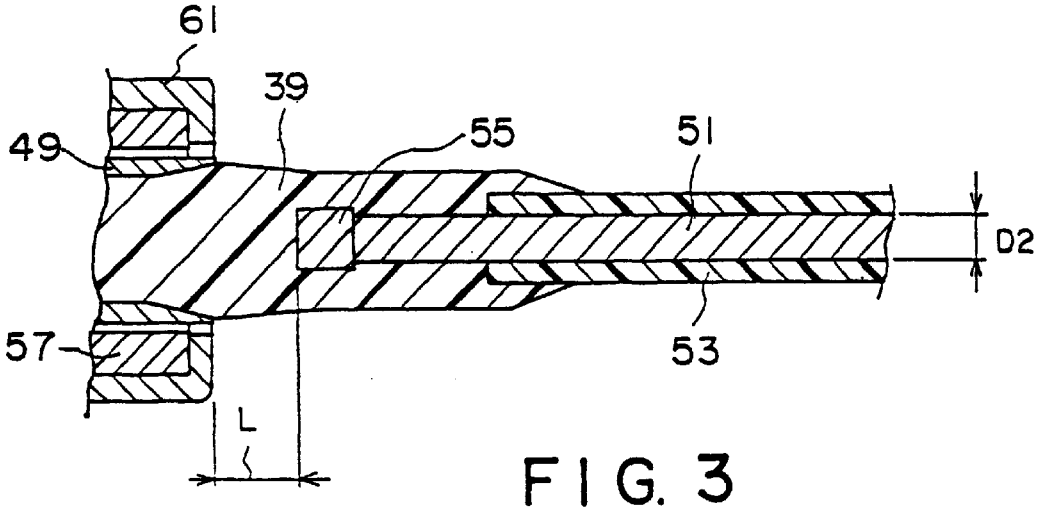
FIG. 3 is an enlarged sectional view of a joint member between first and second antenna portions of the antenna illustrated in FIG. 2.

As best shown in FIG. 3, the whip antenna element 51 is provided with a head portion 55 formed at its one end within the joint member 39. The head portion 55 is formed by deforming process such as staking or swaging and is at least partially greater in a radial direction than a remaining portion of the whip antenna element 51. Alternatively, the head portion 55 may have a cylindrical shape greater in the radial direction than that of the remaining portion of the whip antenna element 51. In the illustrated example, the head portion 55 is integrally formed with the whip antenna by a deforming process. Alternatively, the head portion 55 may be a separate component of an annular shape which is fixed to the one end of the whip antenna element 51.

At the other end of the whip antenna element 51 opposite to the one end connected to the joint member 39, a stopper 57 is formed and electrically connected to the whip antenna element 51.

A holder 61 with an internal spring 59 arranged along its inner surface is fitted around the second antenna portion 41 so that the second antenna portion 41 is slidable through the holder 61. The holder 61 is attached to a housing (7 in FIG. 1) of a radio apparatus and enables the antenna assembly to be retracted into the housing. The holder 61 and at least the spring 59 are made of metal, like the known antenna assembly.

When the antenna assembly 35 is in a retracted position, the helical antenna element 43 alone is exposed out of the housing and serves to receive a radio signal. At this time, the sleeve 49 electrically connected to the helical antenna element 43 is brought into contact with the internal spring 59 of the holder 61 to serve as a feeding portion for the helical antenna element 43. In addition, the antenna assembly 35 in the retracted position is held and fixed by the internal spring 59.

When the antenna assembly 35 is in an extended position, the stopper 57 formed at the other end of the second antenna portion 41 serves as a feeding portion in contact with the internal spring 59 of the holder 61, like the sleeve 49 in the retracted position. Again, the antenna assembly 35 in the extended position is held and fixed by the internal spring 59.

The joint member 39 is made of a nonconductive resin material formed by insertion molding and mechanically connects or joins the sleeve 49 with one end of the second antenna portion 41.

Specifically, as best shown in FIG. 3, the joint member 39 is made of a plastic resin (generally, nylon resin) and connects the first and the second antenna portions 37 and 41. By the joint member 39, the sleeve 49 of the first antenna portion 37 and the head portion 55 at the one end of the whip antenna element 51 of the second antenna portion 41 are mechanically fixed with a distance L left between the extended end of the exposed portion of the sleeve 49 and an end of the head portion of the whip antenna. The distance L is selected to be between 4 and 7 mm for the following reason. Specifically, in order to avoid mutual interference upon operation of each of the first and the second antenna portions 37 and 41, it is preferred that the distance L is as great as possible. However, if the distance L is too great, mechanical strength is dramatically decreased. The above-mentioned range is determined based on the tradeoff between the mutual interference and the mechanical strength.

Through comparative tests with the dimensions of the mechanical components kept unchanged, the present inventor has confirmed the following. That is, when the distance L is equal to 3 mm, the resonance frequency in the retracted position is reduced by several tens of megahertz as compared with the case where the distance L is equal to 4 mm or more. Thus, occurrence of substantial interference has been confirmed when the distance L is less than 4 mm.

Furthermore, by selecting the distance L within the above-mentioned range (4 to 7 mm), ideal dimensions of the respective components have been investigated. As a result of an insulator breaking test and a whip antenna bending test, it has been confirmed that, for use in a PDC (Personal Digital Cellular) using 800 MHz, the outer diameter D2 of the whip antenna is preferably between 0.5 and 1 mm.

Figure 4:
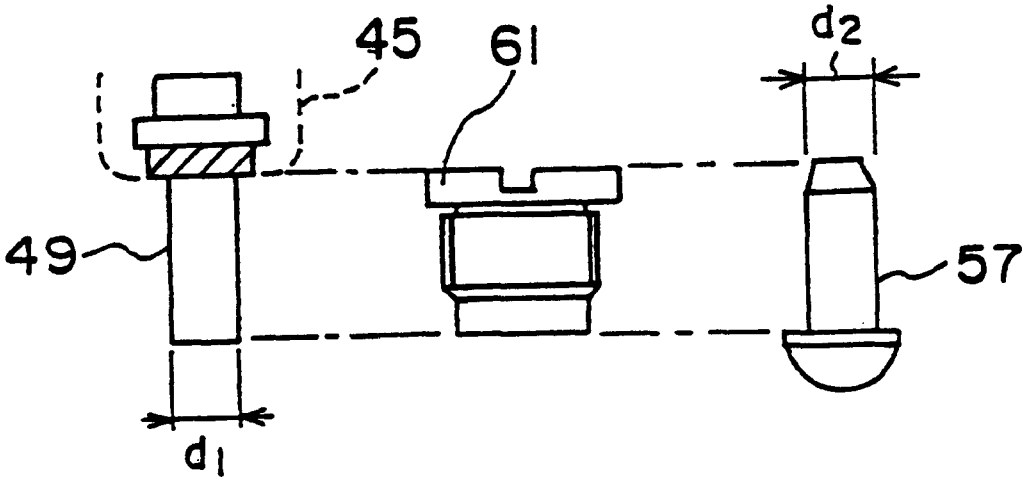
FIG. 4 is a view for describing the relationship in length of components related to a feeding function of the antenna assembly illustrated in FIG. 2.

As a result of a tensile test and a dropping test, it has been confirmed that each of the outer diameters d1 and d2 of the sleeve 49 and the stopper 57 is preferably between 2.5 and 3 mm, as illustrated in FIG. 4.

With the above-mentioned structure, it is possible to assure the characteristics at least as equivalent as those of the typical antenna assembly.

Figure 5:
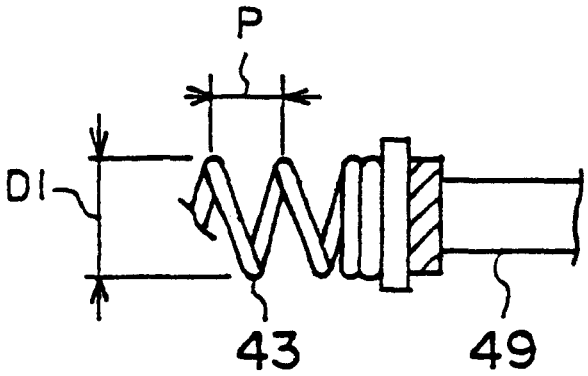
FIG. 5 shows a helical antenna of the antenna assembly illustrated in FIG. 2 before it is enclosed in an antenna top.

Referring to FIG. 5, if the helical antenna element 43 has an outer diameter D1 between 5 and 6 mm and a winding pitch P between 1 and 3 mm, excellent helical antenna characteristics can be obtained.

With the above-mentioned structure, the helical antenna element 43 is independently rendered active in the retracted position while the whip antenna element 51 is independently rendered active in the extended position. Thus, the electrical characteristics of two antennas 43 and 51 can be freely controlled so that a matching circuit can readily be formed. By adjusting the frequencies of the two antennas 43 and 51 to be different from each other, the antenna assembly can be used as a two-resonance antenna switched by extension and retraction of the antenna assembly.

As far as each of the length of the exposed portion of the sleeve 49 which is to be contacted with the holder 61 and the length conductive portion of the stopper 57 which is to be contacted with the holder 61 is equal to or greater than the length of the holder 61 as shown in FIG. 4, the effect of this invention can be achieved. Taking into account the reduction in weight, these lengths are preferably equal to each other.

The antenna assembly is attached through the holder to the housing of the mobile radio apparatus (not shown), such as a mobile telephone apparatus and is electrically connected to a transceiver circuit of the mobile radio apparatus.

As described above, desired characteristics can readily be obtained according to this invention both in the extended and the retracted positions. Thus, the antenna assembly of this invention is excellent in characteristic and easy in formation of the matching circuit. In addition, it is possible to provide the antenna assembly which has a single integral body and which is capable of switching between two different characteristics by extension and retraction.

Industrial Applicability

As described in the foregoing, the antenna assembly according to this invention is useful as an antenna to be attached to the housing of the mobile radio apparatus for radio communication. The mobile radio apparatus with the antenna assembly is useful as a mobile telephone apparatus, a radio communication apparatus, and so on.

What is claimed is:

1. A mobile radio apparatus comprising a radio transceiver circuit, a housing accommodating the radio transceiver circuit, and an antenna assembly electrically connected to the radio transceiver circuit and mounted to said housing to be retractable in said housing into a retracted position and extendable out of said housing into an extended position, said antenna assembly comprising a first antenna portion, a second antenna portion and an insulator joint member joining said first antenna portion with said second antenna portion into a linear form to extend in one direction, wherein:

said first antenna portion comprises a helical antenna element having one end as a helical terminal, an insulator antenna top enclosing said helical antenna element, and a conductive sleeve connected to said helical terminal of said helical antenna element and having an exposed portion extending outward from said antenna top to an extending end in said one direction;

said second antenna portion comprises a whip antenna element having a whip end portion fixed with said joint member and having an opposite whip end, and a conductor stopper fixed to said opposite whip end;

said joint member is made of insulator material formed into a rod shape having first and second joint end portions opposite to each other, said first joint end portion being fixed to said whip end portion of said whip antenna element, and said second joint end portion being fixedly fitted in said exposed portion of said conductive sleeve, so that said joint member has an intermediate portion having a length selected from a range of 4 to 7 mm left between said whip end portion of said whip antenna element and said extending end of said conductive sleeve;

said conductive sleeve acts as a feed to said first antenna portion from said transceiver circuit when said antenna assembly is in the retracted position, and said stopper acts as a feed to said second antenna portion from said transceiver circuit when said antenna assembly is an extended position; and said joint member comprises a tapered peripheral surface at a range between said conductive sleeve and said whip antenna element, said tapered peripheral surface having a diameter at one end of said conductive sleeve larger than that at one end of said whip antenna element.

2. A mobile radio apparatus as claimed in claim 1, wherein:

said antenna assembly comprises a holder fitted around said whip antenna element, said holder having an internal spring arranged along an inner surface thereof so that said whip antenna element and said joint member are slidable through said holder in a lengthwise direction, said holder being fixedly mounted to said housing to support said antenna assembly, and said holder having an axial holder length and a holder inner diameter and having a conductive feeding portion therein electrically connected to said transceiver circuit; and said exposed portion of said conductive sleeve has an axial length and an outer diameter substantially equal to said axial holder length and said holder inner diameter, respectively, and said stopper has a conductive portion also of an axial length and an outer diameter substantially equal to said axial holder length and said holder inner diameter.

3. A mobile radio apparatus as claimed in claim 2, wherein said holder inner diameter is selected from a value between 2.5 and 3 mm.

4. A mobile radio apparatus as claimed in claim 1, wherein said whip antenna element is provided with a head portion formed at said whip end portion, said head portion being at least partially greater in a radial direction than a remaining portion of said whip antenna element, and said head portion being formed by swaging or staking.

5. An antenna assembly which comprises first and second antenna portions connected to each other through a joint member to extend in one direction and which is adapted to be retracted and extended, wherein:

said first antenna portion comprises a helical antenna element having one end as a helical terminal, an insulator antenna top enclosing said helical antenna element, and a conductive sleeve connected to said helical terminal of said helical antenna element and having an exposed portion extending outward from said antenna top to an extending end in said one direction;

said second antenna portion comprises a whip antenna element having a whip end portion fixed with said joint member and having an opposite whip end, and a conductor stopper fixed to said opposite whip end; and said joint member is made of insulator material formed into a rod shape having first and second joint end portions opposite to each other, said first joint end portion being fixed to said whip end portion of said whip antenna element, and said second joint end portion being fixedly fitted in said exposed portion of said conductive sleeve, so that said joint member has an intermediate portion having a length selected from a range of 4 to 7 mm left between said whip end portion of said whip antenna element and said extending end of said conductive sleeve;

said conductive sleeve acts as a feeding portion for said first antenna portion when said antenna assembly is in a retracted position, and said stopper acts as a feeding portion for said second antenna portion when said antenna assembly is an extended position; and said joint member comprises a tapered peripheral surface at a range between said conductive sleeve and said whip antenna element, said tapered peripheral surface having a diameter at one end of said conductive sleeve larger than that at one end of said whip antenna element.

6. An antenna assembly as claimed in claim 5, wherein:

said antenna assembly comprises a holder fitted around said whip antenna element, said holder having an internal spring arranged along an inner surface thereof so that said whip antenna element and said joint member are slidable through said holder in a lengthwise direction, said holder being fixedly mounted to said housing to support said antenna assembly, and said holder having an axial holder length and a holder inner diameter and having a conductive feeding portion; and said exposed portion of said conductive sleeve has an axial length and an outer diameter substantially equal to said axial holder length and said holder inner diameter, respectively, and said stopper has a conductive portion also of an axial length and an outer diameter substantially equal to said axial holder length and said holder inner diameter.

7. An antenna assembly as claimed in claim 6, wherein said holder inner diameter is selected from a value between 2.5 and 3 mm.

8. An antenna assembly as claimed in claim 5, wherein said whip antenna element is provided with a head portion formed at said whip end portion, said head portion being at least partially greater in a radial direction than a remaining portion of said whip antenna element, and said head portion being formed by swaging or staking.

9. An antenna assembly as claimed in claim 5, wherein said helical antenna element has an outer diameter between 5 and 6 mm and a winding pitch between 1 and 3 mm.

10. An antenna assembly as claimed in claim 5, wherein said whip antenna element has an outer diameter between 0.5 and 1 mm.

* * * * *